US011495157B2

(12) United States Patent
Lee

(10) Patent No.: US 11,495,157 B2
(45) Date of Patent: Nov. 8, 2022

(54) PANEL CONTROL CIRCUIT AND DISPLAY DEVICE INCLUDING PANEL CONTROL CIRCUIT

(71) Applicant: Magnachip Semiconductor, Ltd., Cheongju-si (KR)

(72) Inventor: Duk Min Lee, Seoul (KR)

(73) Assignee: MagnaChip Semiconductor, Ltd., Cheongju-si (KR)

( * ) Notice: Subject to any disclaimer, the term of this patent is extended or adjusted under 35 U.S.C. 154(b) by 0 days.

(21) Appl. No.: 17/151,960

(22) Filed: Jan. 19, 2021

(65) Prior Publication Data

US 2021/0407359 A1 Dec. 30, 2021

(30) Foreign Application Priority Data

Jun. 25, 2020 (KR) ..... 10-2020-0077991

(51) Int. Cl.
*G09G 3/20* (2006.01)

(52) U.S. Cl.
CPC ..... *G09G 3/20* (2013.01); *G09G 2310/0291* (2013.01); *G09G 2310/08* (2013.01); *G09G 2340/125* (2013.01); *G09G 2370/08* (2013.01)

(58) Field of Classification Search
CPC ..... G09G 3/20; G09G 2310/0291; G09G 2310/08; G09G 2340/125; G09G 2370/08; G09G 2360/16; G09G 3/3275; G09G 3/2074; G09G 2330/021; G09G 2360/18
See application file for complete search history.

(56) References Cited

U.S. PATENT DOCUMENTS

| | | | | |
|---|---|---|---|---|
| 8,179,345 | B2 | 5/2012 | Woo et al. | |
| 9,508,276 | B2 * | 11/2016 | Hirakata | G09G 3/20 |
| 10,003,226 | B2 * | 6/2018 | Kim | H02K 1/276 |
| 10,008,146 | B2 * | 6/2018 | Guo | G09G 3/2092 |
| 10,078,980 | B2 * | 9/2018 | Kong | G09G 3/2003 |
| 2003/0006955 | A1 * | 1/2003 | Tsuchi | G09G 3/3688 345/92 |
| 2003/0117360 | A1 * | 6/2003 | Bu | G09G 3/3688 345/90 |
| 2016/0098966 | A1 * | 4/2016 | Kim | G09G 3/3614 345/690 |
| 2016/0098967 | A1 * | 4/2016 | Kwon | G09G 3/3614 345/100 |
| 2016/0125840 | A1 * | 5/2016 | Oh | G09G 5/006 345/76 |
| 2016/0162242 | A1 * | 6/2016 | Xiong | G06F 3/147 345/5 |
| 2016/0372044 | A1 * | 12/2016 | Kwon | G09G 3/3291 |
| 2017/0047044 | A1 * | 2/2017 | Zheng | G09G 3/20 |

(Continued)

*Primary Examiner* — Grant Sitta
(74) *Attorney, Agent, or Firm* — NSIP Law

(57) ABSTRACT

A panel control circuit for controlling a display panel comprising a first data line and a second data line includes a timing controller configured to generate input data comprising a first input data and a second input data, a first driving circuit configured to output a first video signal corresponding to the first input data into the first data line, and a second driving circuit configured to output a second video signal corresponding to the second input data into the second data line, wherein the timing controller is configured to turn off the second driving circuit based on a first deviation, a second deviation, or a third deviation.

22 Claims, 11 Drawing Sheets

(56) References Cited

U.S. PATENT DOCUMENTS

| | | | | |
|---|---|---|---|---|
| 2017/0270864 | A1* | 9/2017 | So | G09G 3/3258 |
| 2017/0287429 | A1* | 10/2017 | Kong | G09G 3/3685 |
| 2018/0122292 | A1* | 5/2018 | Ju | G09G 3/20 |
| 2019/0197945 | A1* | 6/2019 | Kim | G09G 3/20 |
| 2020/0388205 | A1* | 12/2020 | Bae | G09G 3/2003 |

* cited by examiner

PANEL CONTROL CIRCUIT AND DISPLAY DEVICE INCLUDING PANEL CONTROL CIRCUIT

CROSS REFERENCE TO RELATED APPLICATIONS

This application claims priority to Korean Patent Application No. 10-2020-0077991, filed on Jun. 25, 2020 in the Korean Intellectual Property Office, the entire disclosure of which is incorporated herein by reference for all purposes.

BACKGROUND

1. Field

The following description relates to a panel control circuit. The following description also relates to a display device including such a panel control circuit.

2. Description of Related Art

A display panel may include subpixels capable of emitting light. Examples of such a display panel may be a liquid crystal display (LCD) panel, a plasma display panel (PDP), and an organic light emitting display (OLED) panel.

Meanwhile, with the increase of the resolution of such a display panel, the number of the subpixels included in the display panel may increase, and thus, power consumption of a driver that drives the display panel may be increased, accordingly. Also, a time that may be obtained in order to drive one gate line of the display panel, with respect to the same frame rate, may be reduced accordingly, as well.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a panel control circuit for controlling a display panel including a first data line and a second data line includes a timing controller configured to generate input data including a first input data and a second input data, a first driving circuit configured to output a first video signal corresponding to the first input data into the first data line, and a second driving circuit configured to output a second video signal corresponding to the second input data into the second data line, wherein the timing controller is configured to turn off the second driving circuit based on a first deviation between the first input data of a current line and the second input data of the current line, a second deviation between the first input data of the current line and the second input data of a previous line, or a third deviation between the first input data of the current line and the first input data of the previous line.

The timing controller may be configured to generate a control data used for turning off the second driving circuit, based on the first deviation and the second deviation, or the third deviation.

The timing controller may include an input data generation circuit configured to generate the input data, an input data buffer configured to store input data of the previous line generated by the input data generation circuit, and a control data generation circuit configured to generate the control data by using input data of the current line transmitted from the input data generation circuit and the input data of the previous line read from the input data buffer.

The control data generation circuit may include at least one logic circuit configured to calculate the first deviation, the second deviation, and the third deviation.

In response to the first deviation being equal to or less than a first reference deviation and in response to the second deviation being equal to or less than a second reference deviation, or the third deviation being equal to or less than a third reference deviation, the timing controller may be configured to generate the control data used for turning off the second driving circuit.

The first reference deviation may be less than the second reference deviation and less than the third reference deviation.

The timing controller may be configured to generate the control data as 1-bit data.

The timing controller may be configured to pad the control data onto the second input data, and configured to output the second input data onto which the control data has been padded into the second driving circuit.

The first driving circuit may include a first latch configured to store the first input data, a first conversion circuit configured to convert the first input data output from the first latch into an analog value, and a first output buffer configured to output the first video signal using the analog value output by the first conversion circuit.

The second driving circuit may include a second latch configured to store the second input data, a second conversion circuit configured to convert the second input data output from the second latch into an analog value, and a second output buffer configured to output a second video signal using the analog value output by the second conversion circuit, wherein the second latch may be configured to receive the control data and configured to output the control data into the second conversion circuit, and wherein the second conversion circuit may be configured to generate a control signal for turning off the second output buffer, based on the control data.

The panel control circuit may further include a switch configured to transfer the output of the first output buffer into an output terminal of the second output buffer, wherein the switch is turned on in response to the control signal.

The panel control circuit may further include a switch that electrically connects the first driving circuit and the second driving circuit when the second driving circuit is turned off.

In another general aspect, a panel control circuit for controlling a display panel including data lines includes driving circuits configured to output a plurality of input data into the data lines, a timing controller configured to output the plurality of input data, and an output switching circuit configured to switch a portion of the plurality of input data and configured to output into the data lines, wherein the timing controller is configured to turn off a driving circuit that outputs a fifth input data, based on a first deviation between a first input data of a current line and the fifth input data of the current line, a second deviation between the first input data of the current line and a seventh input data of a previous line, or a third deviation between the first input data of the current line and a third input data of the previous line.

The timing controller may be configured to generate a control data used for turning off the driving circuit that outputs the fifth input data, based on the first deviation and the second deviation or the third deviation.

The timing controller may be configured to generate the control data used for turning off the driving circuit that outputs the fifth input data, in response to the first deviation being equal to or less than a first reference deviation and in response to the second deviation being equal to or less than a second reference deviation, or the third deviation being equal to or less than a third reference deviation.

The timing controller may be configured to pad the control data onto the fifth input data, and may be configured to output the padded data through the driving circuit that outputs the fifth input data.

In another general aspect, a panel control circuit for controlling a display panel including data lines includes driving circuits configured to output a plurality of input data into the data lines, a timing controller configured to output the plurality of input data, and an output switching circuit configured to switch a portion of the plurality of input data and outputs to the plurality of data lines, wherein the timing controller turns off a driving circuit that outputs a seventh input data, based on a first deviation between a third input data of a current line and the seventh input data of the current line, a second deviation between the third input data of the current line and a fifth input data of a previous line, or a third deviation between the third input data of the current line and a first input data of the previous line.

The timing controller may be configured to generate a control data for turning off the driving circuit that outputs the seventh input data, based on the first deviation and the second deviation or the third deviation.

The timing controller may be configured to generate the control data for turning off the driving circuit that outputs the seventh input data, in response to the first deviation being equal to or less than a first reference deviation and in response to the second deviation being equal to or less than a second reference deviation, or the third deviation being equal to or less than a third reference deviation.

The timing controller may be configured to pad the control data onto the seventh input data, and configured to output the padded data through the driving circuit that outputs the seventh input data.

In another general aspect, a panel control circuit for controlling a display panel including a first data line and a second data line includes a timing controller configured to generate input data including a first input data and a second input data, a first driving circuit configured to output a first video signal corresponding to the first input data into the first data line, and a second driving circuit configured to output a second video signal corresponding to the second input data into the second data line, wherein the timing controller is configured to turns off the second driving circuit based on a deviation between an input data of the current line and another input data.

The timing controller may be configured to turn off the second driving circuit based on a first deviation between the first input data of a current line and the second input data of the current line, a second deviation between the first input data of the current line and the second input data of a previous line, or a third deviation between the first input data of the current line and the first input data of the previous line.

The timing controller may be configured to generate a control data used for turning off the second driving circuit, based on the first deviation and the second deviation or the third deviation.

The panel control circuit may further include a switch that electrically connects the first driving circuit and the second driving circuit when the second driving circuit is turned off.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
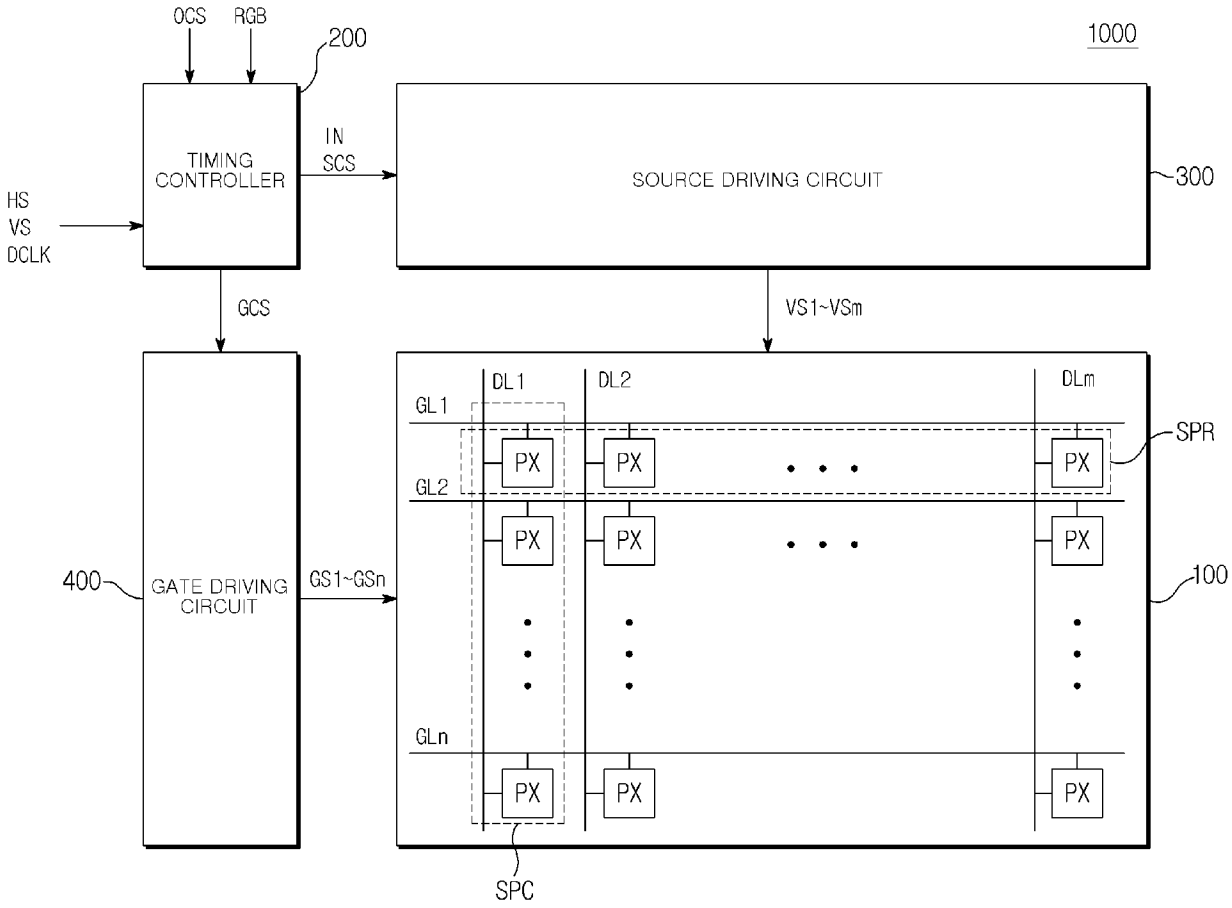
FIG. 1 shows a display device, according to one or more embodiments.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Herein, it is noted that use of the term "may" with respect to an example or embodiment, e.g., as to what an example or embodiment may include or implement, means that at least one example or embodiment exists where such a feature is included or implemented while all examples and embodiments are not limited thereto.

A purpose of the present disclosure is to provide a panel control circuit that may be capable of reducing the power consumption of the driver which drives the display panel, and a display device including the same.

The panel control circuit according to the embodiments may turn off a portion of the driving circuit among the driving circuits on the basis of a deviation between the input data of a current line and a deviation between the input data of the current line and the input data of a previous current line. Accordingly, not only the same color representation may be implemented but also the power consumption of the panel control circuit may be reduced.

FIG. 1 shows a display device, according to one or more embodiments. Referring to FIG. 1, the display device 1000 may display images or videos. For example, the display device 1000 may refer to a TV, a smartphone, a tablet PC, a mobile phone, a video phone, an e-book reader, a computer, a camera, a wearable device, and so on as non-limiting examples, and is not limited to these enumerated examples.

The display device 1000 may include a display panel 100, a timing controller 200, a source driving circuit 300, and a gate driving circuit 400. According to the one or more embodiments, the gate driving circuit 400 may be formed integrally with the display panel 100. The timing controller 200 and the source driving circuit 300 may be referred to as a panel control circuit. However, embodiments are not necessarily limited to these enumerated embodiments.

The display panel 100 may be configured to output video. For example, the display panel 100 may be implemented as one of a liquid crystal display (LCD), light emitting diode (LED) display, organic LED (OLED) display, active-matrix OLED (AMOLED) display, Electrochromic Display (ECD), Digital Mirror Device (DMD), Actuated Mirror Device (AMD), Grating Light Valve (GLV), Plasma Display Panel (PDP), Electro Luminescent Display (ELD), Vacuum Fluorescent Display (VFD), as non-limiting examples, but is not limited to these enumerated examples.

The display panel 100 may include a plurality of subpixels PX that emit light. The plurality of subpixels PX may be arranged in rows and columns. For example, the plurality of subpixels PX may be arranged in the form of a lattice structure, composed of n rows and m columns, where n and m are natural numbers. With respect to display panel 100, a row in which the subpixels PX are arranged is referred to as a subpixel row SPR, and a column in which the subpixels PX are arranged is referred to as a subpixel column SPC. For example, in FIG. 1, a first SPC, a second SPC, . . . , a $m^{th}$ SPC may be arranged from left to right, providing an array of columns of subpixels PX.

The subpixels PX may each be a basic unit that may emit light. Each of the subpixels PX may include a driving element. According to the one or more embodiments, light emitted from each of the subpixels PX may be one of red, green, and blue colors, and may not be limited to these enumerated embodiments. For example, white light may be output from the subpixels PX.

According to the one or more embodiments, the subpixels PX may include a light emitting device configured to emit light and a pixel circuit that drives the light emitting device. The pixel circuit may include a plurality of switching elements, and the plurality of switching elements may control the flow of the video signal and a driving voltage applied to the light emitting device. For example, the light emitting device may be a light emitting diode (LED), an organic LED (OLED), a quantum dot LED (QLED), or a micro LED, as non-limiting examples. However, embodiments are not limited to the above types of the light emitting device.

The subpixels PX of the display panel 100 may be driven in units of a gate line, hereinafter, referred to merely as "line." That is, the subpixels PX may be driven in units of the subpixel rows. For example, the subpixels arranged in one gate line may be driven during a first period, and subpixels arranged in another gate line may be driven during a second period that is next to the first period. In such an example, a unit time period during which the subpixels PX are driven may be referred to as 1 horizontal (1H) time period or line.

The timing controller 200 may receive a video data RGB from an external device and may accordingly generate an input data IN by appropriately processing or converting the video data RGB. The timing controller 200 may then transmit the input data IN into the source driving circuit 300.

The timing controller 200 may receive an external control signal OCS from an external device. The external control signal OCS may include a horizontal synchronization signal, a vertical synchronization signal, and/or a clock signal, as non-limiting examples, but is not limited to these enumerated examples.

The timing controller 200 may control the operations of the source driving circuit 300 and the gate driving circuit 400 on the basis of the external control signal OCS. According to the one or more embodiments, the timing controller 200 may receive the external control signal OCS and may generate a source control signal SCS accordingly for controlling the source driving circuit 300 and may generate a gate control signal GCS for controlling the gate driving circuit 400.

The source driving circuit 300 may generate, on the basis of the input data IN and the source control signal SCS, video signals VS1 to VSm that correspond to videos displayed on the display panel 100. Further, the source driving circuit 300 may output the generated video signals VS1 to VSm into the display panel 100. According to the one or more embodiments, the source driving circuit 300 may generate the video signals VS1 to VSm having a voltage value corresponding to the input data IN.

The source driving circuit 300 may output sequentially the video signals VS1 to VSm that are to be output for each subpixel row. According to the one or more embodiments, the source driving circuit 300 may provide, during the 1H time period, the video signals VS1 to VSm to the subpixels PX which are driven in the 1H time period. Thus, the video signals VS1 to VSm output from the source driving circuit 300 may be transferred to each of the subpixels PX through data lines DL1 to DLm of the display panel 100.

The gate driving circuit 400 may output sequentially a plurality of gate signals GS1 to GSn in response to receiving the gate control signal GCS. According to the one or more embodiments, the gate driving circuit 400 may generate the gate signals GS1 to GSn by using the gate control signal GCS.

The gate signals GS1 to GSn are used for turning on the subpixels PX connected to the gate lines GL1 to GLn, respectively, and may be applied to a gate terminal of a transistor included in each of the subpixels PX. According to the one or more embodiments, each of the gate signals GS1 to GSn may include at least one of a scan signal, a light emission signal, and an initialization signal, as non-limiting examples.

According to the one or more embodiments, at least two of the timing controller 200, the source driving circuit 300, and the gate driving circuit 400 may be implemented using one integrated circuit. Also, according to the one or more embodiments, at least two of the timing controller 200, the source driving circuit 300, and the gate driving circuit 400 may be implemented as being mounted on the display panel 100.

Figure 2:
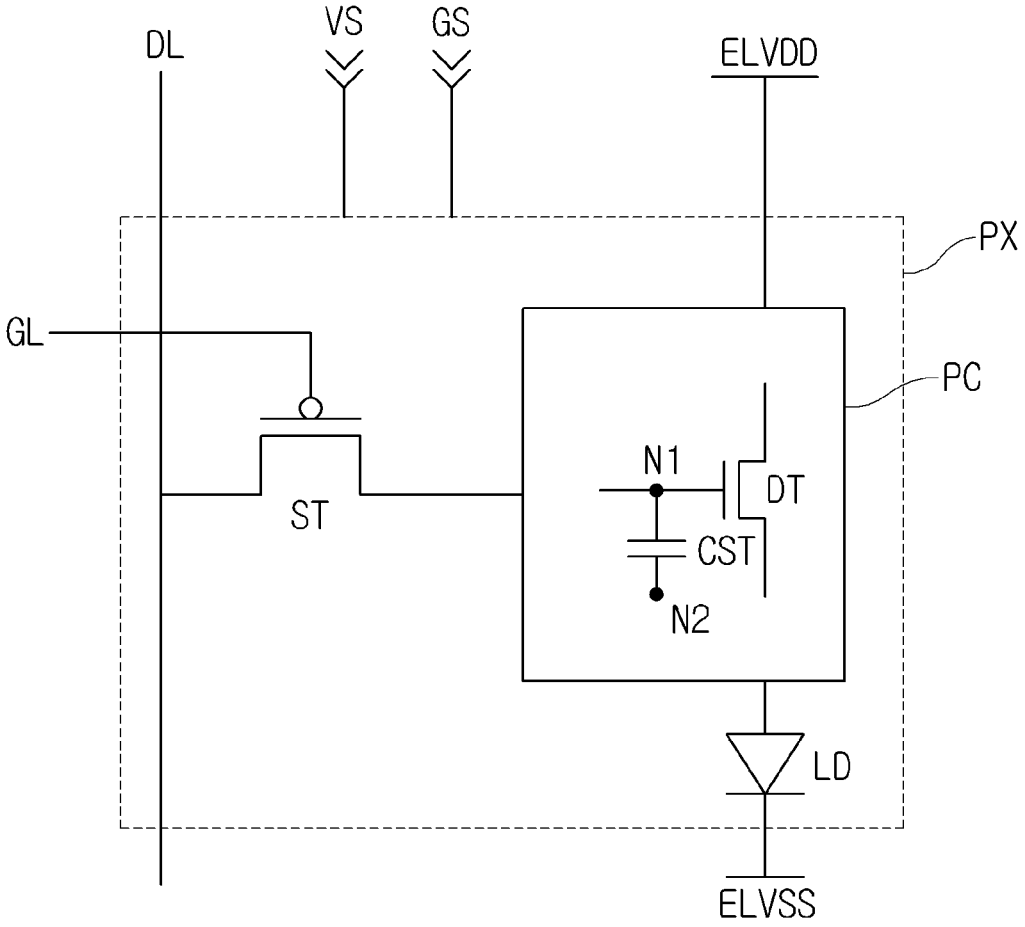
FIG. 2 shows subpixels, according to one or more embodiments.

FIG. 2 shows the subpixels, according to one or more embodiments. FIG. 2 illustrates the subpixel PX connected between the data line DL and the gate line GL.

Referring to FIGS. 1 and 2, the subpixel PX may include a switching transistor ST, a pixel circuit PC connected to the switching transistor, and a light emitting device LD connected to the pixel circuit, according to one or more non-limiting examples.

For example, the subpixel PX may be connected to the data line DL and the gate line GL, and may operate according to receiving the video signal VS, the gate signal GS, and driving voltages ELVDD and ELVSS.

The video signal VS may be applied through the data line DL, and the gate signal GS may be applied through the gate line GL, but the transmission of the video signal VS and the gate signal GS are not limited to these enumerated example approaches. For example, the gate signal GS may be transmitted through another conductive line instead of through the gate line GL.

A first electrode, for example, a source electrode, of the switching transistor ST may be electrically connected to the data line DL, and a second electrode, for example, a drain electrode, may be electrically connected to the pixel circuit PC. A gate electrode of the switching transistor ST may be electrically connected to the gate line GL. When a gate signal at a gate-on level is applied to the gate line GL, the switching transistor ST may be turned on and may transmit the video signal applied to the data line DL into the pixel circuit PC.

The pixel circuit PC may control the light emitting device LD on the basis of the gate signal GS and the driving voltage ELVDD. According to the one or more embodiments, the pixel circuit PC may control the amount of a driving current that flows through the light emitting device LD, in response to the received gate signal GS.

The pixel circuit PC may include a driving transistor DT connected between the light emitting device LD and the driving voltage ELVDD, and may also include a storage capacitor CST connected to an end of the driving transistor.

Such a storage capacitor CST may charge a voltage between a first node N1 and a second node N2.

The driving transistor DT may control the amount of the driving current flowing through the light emitting device LD, in response to the voltage being applied to the gate electrode. For example, the driving transistor DT may control the amount of the driving current that flows through the light emitting device LD, on the basis of the gate signal GS applied to the pixel circuit PC.

The light emitting device LD may emit light corresponding to the driving current. For example, the light emitting device LD may emit light corresponding to any one of red, green, blue, and white colors, as non-limiting examples. The light emitting device LD may be an organic light emitting diode (OLED), or a very small inorganic light emitting diode which has a size in a range from micro scale to nano scale, as non-limiting examples, but is not limited to these enumerated examples. Subsequently, in this disclosure, one or more embodiments in which the light emitting device LD is composed of the organic light emitting diode will be described, but the following discussion pertains to examples that use an inorganic light emitting diode or other examples of a light emitting device LD.

Additionally, the structure of the subpixels PX of the present one or more embodiments is not to be construed as being limited to the structure described with reference to FIG. 2. According to the one or more embodiments, the subpixels PX may further include at least one device for compensating for a threshold voltage of the driving transistor DT or for initializing the voltage of the gate electrode of the driving transistor DT and/or a voltage of an anode electrode of the light emitting device LD.

Figure 3:
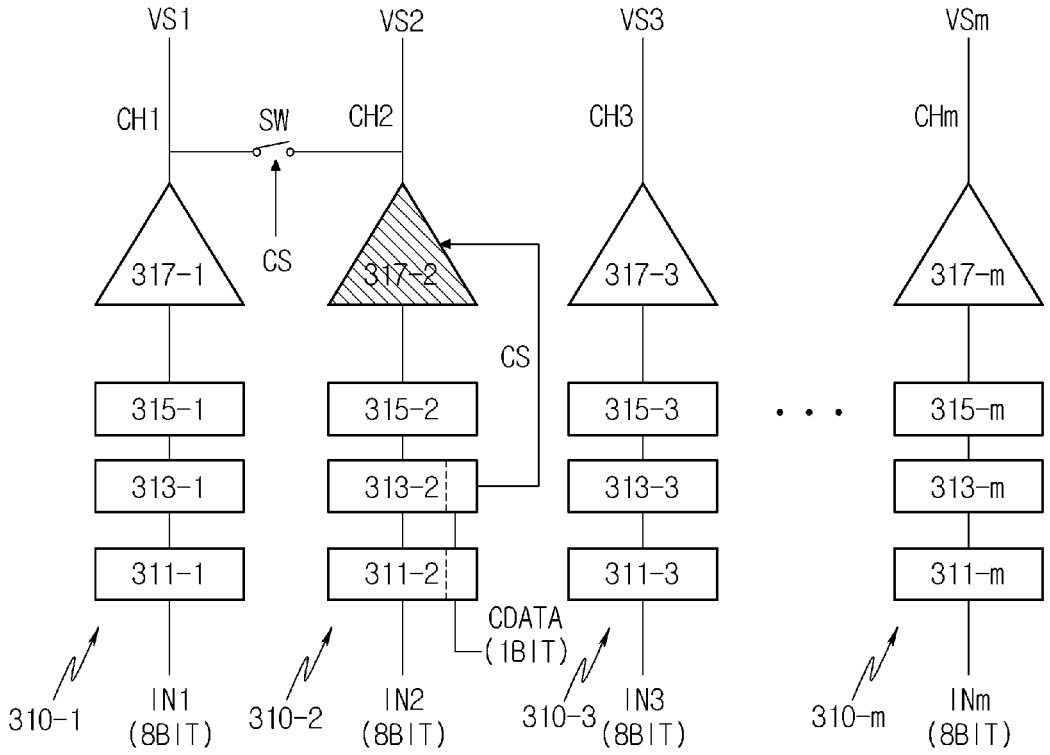
FIG. 3 shows a source driving circuit, according to one or more embodiments.

FIG. 3 shows the source driving circuit, according to one or more embodiments.

Referring to FIGS. 1 to 3, the source driving circuit 300 may include a plurality of driving circuits 310-1 to **310-*m***.

The plurality of driving circuits 310-1 to **310-*m* may receive the input data IN1 to INm transmitted from the timing controller 200, respectively, and may accordingly output the video signals VS1 to VSm, corresponding to the input data IN1 to INm, into the display panel 100. According to the one or more embodiments, the plurality of driving circuits 310-1 to 310-*m* may output the video signals VS1 to VSm into the corresponding subpixel column or data line, respectively. For example, the first driving circuit 310-1 may output the first video signal VS1 into the first subpixel columns connected to the first data line DL1**.

According to the one or more embodiments, the video signals VS1 to VSm may be output through channels CH1 to CHm, connected to the driving circuits 310-1 to **310-*m* respectively, and the channels CH1 to CHm may be connected to the data lines DL1 to DLm, respectively. Meanwhile, although it is described as a non-limiting embodiment in the present disclosure that the number of the channels CH1 to CHm may be the same as the number of the data lines DL1 to DLm, embodiments are not limited to this enumerated embodiment. For example, the number of the channels CH1 to CHm may be different from the number of the data lines DL1 to DLm. Meanwhile, the number of the channels CH1 to CHm may be the same as the number of the driving circuits 310-1 to 310-*m***.

The driving circuits 310-1 to **310-*m* may include latches 311-1 to 311-*m*, level shifters 313-1 to 313-*m*, decoders 315-1 to 315-*m*, and output buffers 317-1 to 317-*m*, respectively. For example, the first driving circuit 310-1 may include the first latch 311-1, the first level shifter 313-1, the first decoder 315-1, and the first output buffer 317-1**, according to a non-limiting example.

According to the one or more embodiments, the level shifters 313-1 to **313-*m* and the decoders 315-1 to 315-*m*** are collectively referred to as a conversion circuit.

The latches 311-1 to **311-*m* may store the input data IN1 to INm transmitted from the timing controller 200. According to the one or more embodiments, the latches 311-1 to 311-*m* may receive and store a plurality of bits corresponding to the input data IN1** to INm.

The latches 311-1 to **311-*m* may output the stored input data IN1 to INm. According to the one or more embodiments, the latches 311-1 to 311-*m* may output the stored input data IN1 to INm into the level shifters 313-1 to 313-*m***.

The level shifters 313-1 to **313-*m* and the decoders 315-1 to 315-*m* may convert the input data IN1 to INm that is in a digital format into analog values, and may then output the analog values, corresponding to the input data IN1 to INm, into the output buffers 317-1 to 317-*m***.

The level shifters 313-1 to **313-*m* may change or interface the level, for example, a voltage that is a logic value reference, of the input data IN1 to INm received from the latches 311-1 to 311-*m*. According to the one or more embodiments, the level shifters 313-1 to 313-*m* may collectively increase or decrease the level of the received input data. For example, the level shifters 313-1 to 313-*m*** may change the level of the received input data from the logical level "1" of a reference voltage of 3.3 V, to the logical level "1" of the reference voltage of 5 V, as a non-limiting example. However, embodiments are not limited to such particular numerical values of the reference voltage, and other suitable reference voltages may be used in other embodiments.

The decoders 315-1 to **315-*m* may output a gradation voltage corresponding to the input data, for example, the input data from the latch or input data converted by the level shifter, into the output buffers 317-1 to 317-*m*. According to the one or more embodiments, through the use of a plurality of reference gradation voltages stored in advance, the decoders 315-1 to 315-*m* may generate the gradation voltage corresponding to the input data and may output the generated gradation voltage to the output buffers 317-1 to 317-*m*** as a result.

According to the one or more embodiments, the plurality of reference gradation voltages may depend on the color, for example, red, green, blue, and white colors, and so on, as non-limiting examples, represented by the subpixels. For example, the reference gradation voltage for the red input data output to the red subpixel may be different from the reference gradation voltage for the green input data output to the green subpixel. Depending on the specific pixel to which the input data is output, the decoders 315-1 to **315-*m*** may use an appropriate reference gradation voltage.

The output buffers 317-1 to **317-*m* may generate the video signals VS1 to VSm by using the gradation voltages output from the decoders 315-1 to 315-*m*, and may output the video signals VS1 to VSm into the display panel 100. According to the one or more embodiments, the output buffers 317-1 to 317-*m* may convert the gradation voltages output from the decoders 315-1 to 315-*m* and may then output the converted voltages as the video signals VS1** to VSm.

According to the one or more embodiments, a first set of the driving circuits 310-1 to **310-*m* may be connected to each other. Depending on the relationship between the input data input into the first set of the driving circuits 310-1 to 310-*m* connected to each other, a portion of the driving circuit within the first set may be turned off, appropriately. Here, the video signal that is alternatively output from the turned-off driving circuit may be output from the other driving circuits within the first set, instead. Accordingly, power consumption for driving the driving circuits 310-1 to 310-*m* may be reduced. Referring to FIG. 3, FIG. 3 illustrates that the first driving circuit 310-1 and the second driving circuit 310-2 among the driving circuits 310-1 to 310-*m* may be connected to each other. The second driving circuit 310-2 may be turned-off based on the control of the timing controller 200, and the output value, that is, the video signal, of the first driving circuit 310-1 may be output instead of the output value of the second driving circuit 310-2. Accordingly, the power consumption of the source driving circuit 300** may be decreased.

According to the one or more embodiments, the first driving circuit 310-1 and the second driving circuit 310-2 among the plurality of driving circuits 310-1 to **310-*m* may be connected to each other by a switch SW. As the second driving circuit 310-2 is turned-off, the switch SW may be turned-on. Then, as the switch SW is turned-on, the first video signal VS1 output by the first driving circuit 310-1 may be transmitted into the output terminal of the second driving circuit 310-2 through the switch SW. Accordingly, the video signal that should be output from the second driving circuit 310-2 may be output from the first driving circuit 310-1 connected to the second driving circuit 310-2**, instead.

According to the one or more embodiments, the video signals generated by the first driving circuit 310-1 and the second driving circuit 310-2 may be output to the subpixels that emit the same color of light. For example, the video signals generated by the first driving circuit 310-1 and the second driving circuit 310-2 may be transmitted to the subpixels that all output the red light, although embodiments are not limited to this specific example.

According to the one or more embodiments, the second driving circuit 310-2 may be turned-off in response to receiving a control data CDATA output from the timing controller 200. For example, the second driving circuit 310-2 may receive the control data CDATA from the timing controller 200, and may generate a control signal CS on the basis of the received control data CDATA. The second driving circuit 310-2 may then be turned-off in response to receiving the control signal CS.

The second latch 311-2 may receive the control data CDATA from the timing controller 200. For example, the second latch 311-2 may receive the second input data IN2 and the control data CDATA as a single unit of data. For example, the control data CDATA may be 1-bit data, as a non-limiting example, but is not limited to this specific example.

The second level shifter 313-2 may generate the control signal CS by changing the level of the control data CDATA. The control signal CS may be applied to the second output buffer 317-2, and the second output buffer 317-2 may be turned-off in response to receiving the control signal CS. Accordingly, the second output buffer 317-2 may not output the second video signal VS2 due to its having been turned-off.

The switch SW connecting the first driving circuit 310-1 and the second driving circuit 310-2 may be turned-on in response to the turning-off of the second driving circuit 310-2. According to the one or more embodiments, the switch SW may be turned-on in response to the control signal CS generated from the second driving circuit 310-2. Accordingly, as the switch SW is turned-on, the video signal output from the first output buffer 317-1 may be output through the second channel CH2, connected to the second driving circuit 310-2, through the switch SW. That is, even though the second driving circuit 310-2 may be turned-off, the video signal generated by the first driving circuit 310-1 may still be output through the second channel CH2 connected to the second driving circuit 310-2. Thus, there may occur an effect that the power consumption of the source driving circuit 300 is reduced.

Meanwhile, FIG. 3 shows that the second driving circuit 310-2, from among the plurality of driving circuits 310-1 to **310-*m***, is turned-off based on receiving the control data CDATA. However, according to the one or more embodiments, at least one of the other driving circuits may be turned-off by the control data CDATA. Here, the turned-off driving circuit may be connected through the switch to the driving circuit that is not turned-off.

Figure 4:
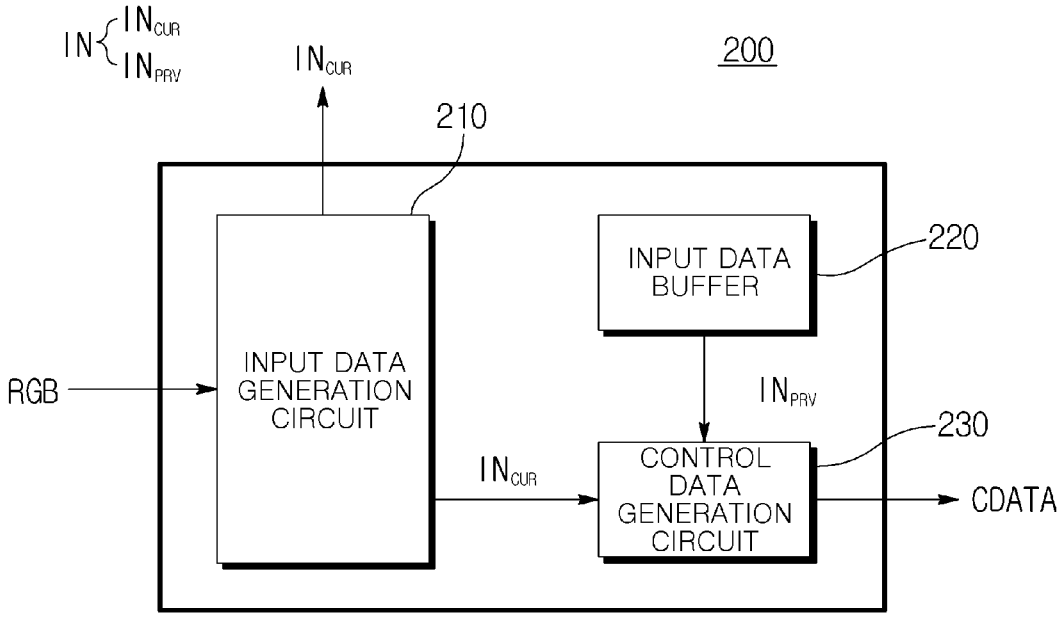
FIG. 4 shows a timing controller, according to one or more embodiments.

FIG. 4 shows the timing controller, according to one or more embodiments. The timing controller 200 may include an input data generation circuit 210, an input data buffer 220, and a control data generation circuit 230, as non-limiting examples.

An input data generation circuit 210 may generate the input data IN by using the video data RGB received from the outside of the timing controller 200. The generated input data IN may be output to the source driving circuit 300. According to the one or more embodiments, the input data generation circuit 210 may generate the input data IN corresponding to the video signal VS to be output to each line of the display panel 100. For example, the input data generation circuit 210 may generate and output the input data $IN_{CUR}$ of a line, hereinafter, referred to as "current line," to which the current video signal VS is output.

The input data buffer 220 may store the input data IN generated by the input data generation circuit 210. According to the one or more embodiments, the input data buffer 220 may store the input data $IN_{PRV}$ of a line, hereinafter, referred to as "previous line," that has been output before the current line.

According to the one or more embodiments, the input data buffer 220 may store the input data IN corresponding to one line, and may update the stored data every time one line is output. For example, the input data $IN_{PRV}$ of the previous line may be stored in the input data buffer 220, and then the stored input data $IN_{PRV}$ of the previous line may be erased and the input data $IN_{CUR}$ of the current line may be stored in the input data buffer 220.

For example, the input data buffer 220 may include at least one of a non-volatile memory and a volatile memory, as a non-limiting example.

The control data generation circuit 230 may generate the control data CDATA used for turning off or turning on a portion of the plurality of driving circuits 310-1 to **310-*m*. According to the one or more embodiments, the control data generation circuit 230** may generate the control data CDATA based on the input data $IN_{PRV}$ of the previous line and the input data $IN_{CUR}$ of the current line.

The control data generation circuit 230 may generate the control data CDATA based on at least one of a comparison result between the video data included in the input data $IN_{CUR}$ of the current line and a comparison result between the input data $IN_{PRV}$ of the previous line and the input data $IN_{CUR}$ of the current line. For example, the control data generation circuit 230 may include at least one logic gate, for example, an OR gate, an AND gate, an XOR gate, a NOR gate, or a NAND gate, and so on, or a combination of such logic gates, which is capable of performing logical comparison operations for the operation of the control data generation circuit 230.

For example, as shown in FIG. 4, the control data generation circuit 230 may generate the control data CDATA on the basis of the input data $IN_{CUR}$ of the current line and the input data $IN_{PRV}$ of the previous line, which are input to the first driving circuit 310-1 and the second driving circuit 310-2 from among the plurality of driving circuits 310-1 to **310-*m*. Then, the control data generation circuit 230 may output the generated control data CDATA into the second driving circuit 310-2**.

According to the one or more embodiments, the control data generation circuit 230 may receive the input data $IN_{CUR}$ of the current line from the input data generation circuit 210, may read the input data $IN_{PRV}$ of the previous line stored in the input data buffer 220, and may generate the control data CDATA by using the input data $IN_{CUR}$ of the current line and the input data $IN_{PRV}$ of the previous line.

Figure 5:
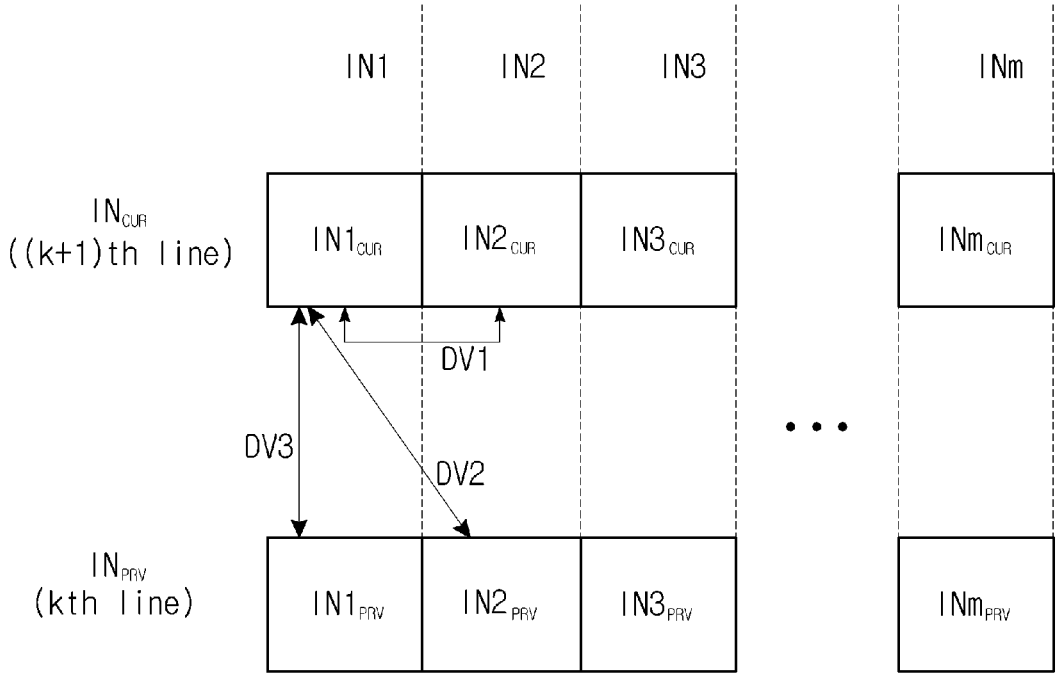
FIG. 5 is a view for describing the operation of a control data generation circuit, according to one or more embodiments.

FIG. 5 is a view for describing the operation of the control data generation circuit, according to one or more embodiments. Referring to FIGS. 1 to 5, the input data $IN_{PRV}$ of the previous line may be an input data of a $k^{th}$ line, and the input data $IN_{CUR}$ of the current line may be an input data of a $k+1^{th}$ line, where k is a natural number having a value of 1 or more, and having a value less than m.

The input data $IN_{PRV}$ and $IN_{CUR}$ may be input into the plurality of driving circuits 310-1 to **310-*m*. According to the one or more embodiments, the input data $IN_{PRV}$ and $IN_{CUR}$ may be divided in units of a size, for example, 8 bits, that may be input into each driving circuit, and each of the units IN1 to INm of the divided input data may be input into the plurality of driving circuits 310-1 to 310-*m*. According to the one or more embodiments, the first input data $IN1_{CUR}$ and $IN1_{PRV}$ of the current line and the previous line may be input into the first driving circuit 310-1, and the second input data $IN2_{CUR}$ and $IN2_{PRV}$ of the current line and the previous line may be input into the second driving circuit 310-2**.

The control data generation circuit 230 may generate the control data CDATA based on the input data $IN_{PRV}$ of the previous line and the input data $IN_{CUR}$ of the current line. According to the one or more embodiments, the control data generation circuit 230 may generate the control data CDATA used for turning off the driving circuit to be controlled, based on a deviation between the input data of the current line, that is input into a driving circuit, for example, the second driving circuit 310-2, in order to be controlled from among the plurality of driving circuits 310-1 to **310-*m*** and the input data of the current line, which is input to another driving circuit, a deviation between the input data of the previous line, which is input to the driving circuit to be controlled and the input data of the current line, which is input to another driving circuit, or a deviation between the input data of the current line, which is input to another driving circuit, and the input data of the previous line, which is input to another driving circuit.

According to the one or more embodiments, when the driving circuit to be controlled is the second driving circuit 310-2 as shown in FIG. 3, the control data generation circuit 230 may generate the control data CDATA based on a first deviation DV1 between the second input data $IN2_{CUR}$ of the current line, which is input to the second driving circuit 310-2, and the first input data $IN1_{CUR}$ of the current line, which is input to the first driving circuit 310-1 connected to the second driving circuit 310-2, and on the basis of a second deviation DV2 between the first input data $IN1_{CUR}$ of the current line and the second input data $IN2_{PRV}$ of the previous line. Additionally, the control data generation circuit 230 may generate the control data CDATA further based on a third deviation DV3 between the first input data $IN1p_R$v of the previous line and the first input data $IN1_{CUR}$ of the current line. For example, the control data generation circuit 230 may generate the control data CDATA based on the first deviation DV1, the second deviation DV2, and/or the third deviation DV3.

According to the one or more embodiments, the control data generation circuit 230 may generate the control data CDATA when the first deviation DV1 between the first input data $IN1_{CUR}$ of the current line and the second input data $IN2_{CUR}$ of the current line is equal to or less than a first reference deviation, when the second deviation DV2 between the first input data $IN1_{CUR}$ of the current line and the second input data $IN2_{PRV}$ of the previous line is equal to or less than a second reference deviation, or when the third deviation DV3 between the first input data $IN1_{CUR}$ of the current line and the first input data $IN1_{PRV}$ of the previous line is equal to or less than a third reference deviation.

According to the one or more embodiments, the first reference deviation may be 0, and the second reference deviation and the third reference deviation may each be 0 or more.

That is, both when the deviation between the input data $IN2_{CUR}$ of the current line, which is input to the second driving circuit 310-2, and the input data $IN1_{CUR}$ of the current line, which is input to the first driving circuit 310-1 connected to the second driving circuit 310-2, is small and when the deviation between the input data $IN1_{CUR}$ of the current line, which is input to the first driving circuit 310-1, and the input data $IN2_{PRV}$ of the previous line, which is input to the second driving circuit 310-2, is small, the timing controller 200 may turn off the second driving circuit 310-2 and may output the output of the first driving circuit 310-1 as the output of the second driving circuit 310-2 instead, regardless of the deviation between the first input data $IN1_{CUR}$ of the current line and the first input data $IN1_{PRV}$ of the previous line. Accordingly, there may occur a resulting effect that the power consumption of the display device 1000 is reduced.

Meanwhile, FIG. 5 shows, as an example, that the control data generation circuit 230 may use the deviation between input data for the first driving circuit 310-1 and the second driving circuit 310-2. However, embodiments are not limited to this particular example of operation. For example, the control data generation circuit 230 may use a deviation between the input data for the second driving circuit 310-2 and an $i^{th}$ driving circuit **310-*i***, where $3 \le i \le m$.

Figure 6:
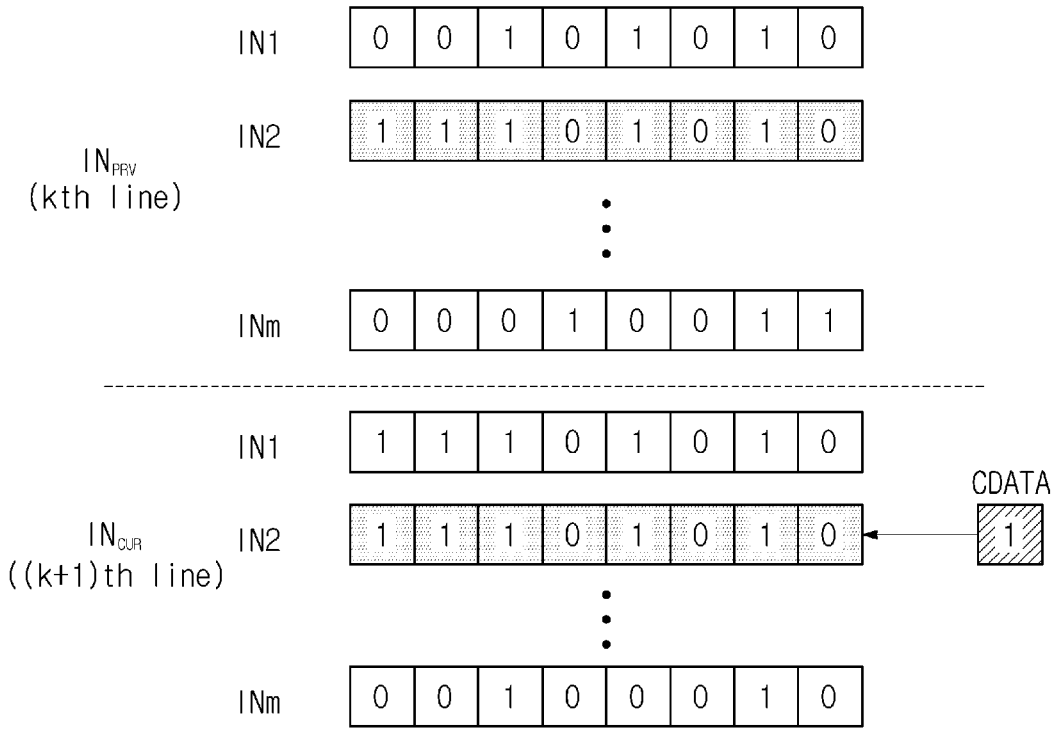
FIG. 6 is a view for describing the operation of the control data generation circuit, according to one or more embodiments.

FIG. 6 is a view for describing the operation of the control data generation circuit, according to one or more embodiments. Referring to FIGS. 1 to 6, the control data generation circuit 230 may generate the control data CDATA based on the input data $IN_{CUR}$ of the current line and the input data $IN_{PRV}$ of the previous line.

As shown in FIG. 6, the second input data $IN2_{CUR}$ of the current line and the first input data $IN1_{CUR}$ of the current line may have the same value of "11101010", and the first input data $IN1_{CUR}$ of the current line and the second input data $IN2_{PRV}$ of the previous line may have the same value of "11101010." In this example, because the first deviation DV1 and the second deviation DV2 are each 0, the control data generation circuit 230 may generate the control data CDATA to have a value of "1" irrespective of the third deviation DV3 between the first input data $IN1_{CUR}$ of the current line and the first input data $IN1_{PRV}$ of the previous line. As described further above, the control data CDATA may be used for turning off the second driving circuit 310-2.

The control data generation circuit 230 may output the control data CDATA into the second driving circuit 310-2. According to embodiments, the control data generation circuit 230 may output the control data CDATA for turning off the second driving circuit 310-2, together with the second input data $IN2_{CUR}$ of the current line, into the second driving circuit 310-2. For example, the control data generation circuit 230 may pad the control data CDATA onto the second input data $IN2_{CUR}$ of the current line. Accordingly, the second driving circuit 310-2 may be turned-off based on the control data CDATA.

Figure 7:
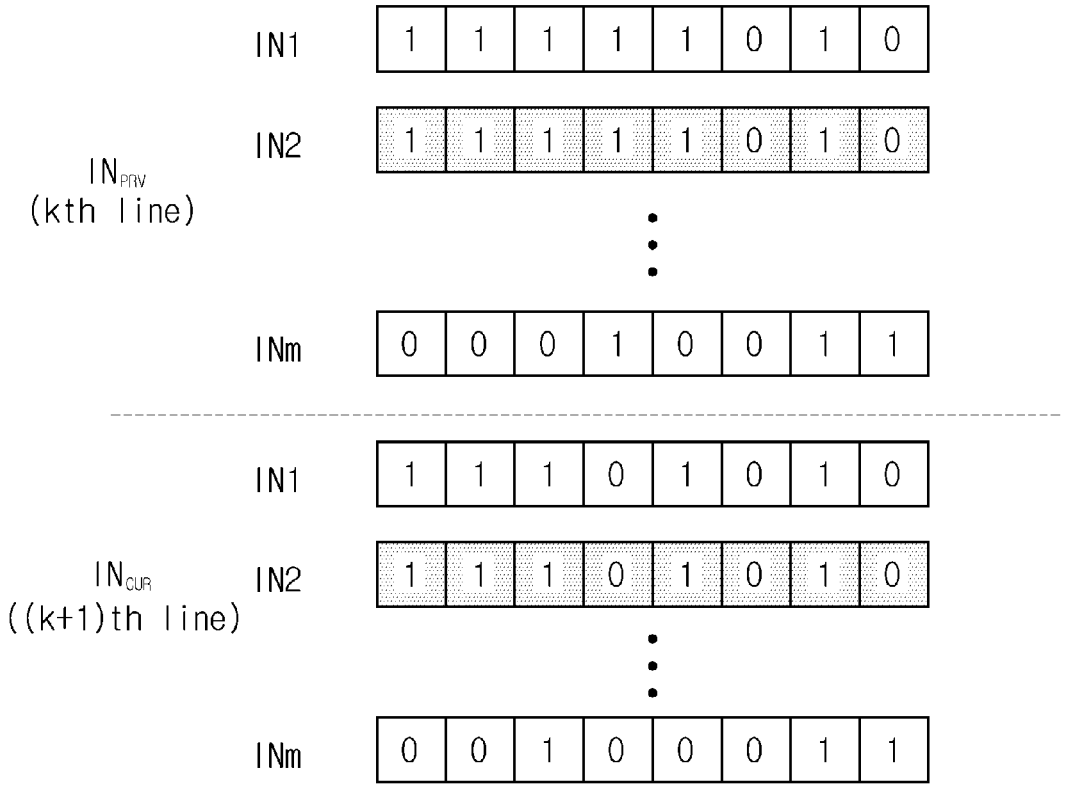
FIG. 7 is a view for describing the operation of the control data generation circuit, according to one or more embodiments.

FIG. 7 is a view for describing the operation of the control data generation circuit, according to one or more embodiments. Referring to FIGS. 1 to 7, the control data generation circuit 230 may generate the control data CDATA on the basis of the input data $IN_{CUR}$ of the current line and the input data $IN_{PRV}$ of the previous line.

As shown in FIG. 7, the second input data $IN2_{CUR}$ of the current line and the first input data $IN1_{CUR}$ of the current line may have the same value as "11101010." However, the second deviation DV2 between the first input data $IN1_{CUR}$ of the current line and the second input data $IN2_{PRV}$ of the previous line may be 16 in the example. Likewise, the third deviation DV3 between the first input data $IN1_{CUR}$ of the current line and the first input data $IN1_{PRV}$ of the previous line is also 16 in the example. Thus, in such an example, when both the second reference deviation and the third reference deviation are less than 16, the second deviation DV2 exceeds the second reference deviation, and the third deviation DV3 also exceeds the third reference deviation. As a result, the control data generation circuit 230 may not generate the control data CDATA.

In other words, according to the one or more embodiments, when the deviation (that is, the second deviation DV2 and the third deviation DV3) between the input data of the current line and the input data of the previous line exceeds the reference deviation, (that is, the second reference deviation and the third reference deviation) the control data CDATA may not be generated, and thus, the driving circuit may not be turned-off.

Figure 8:
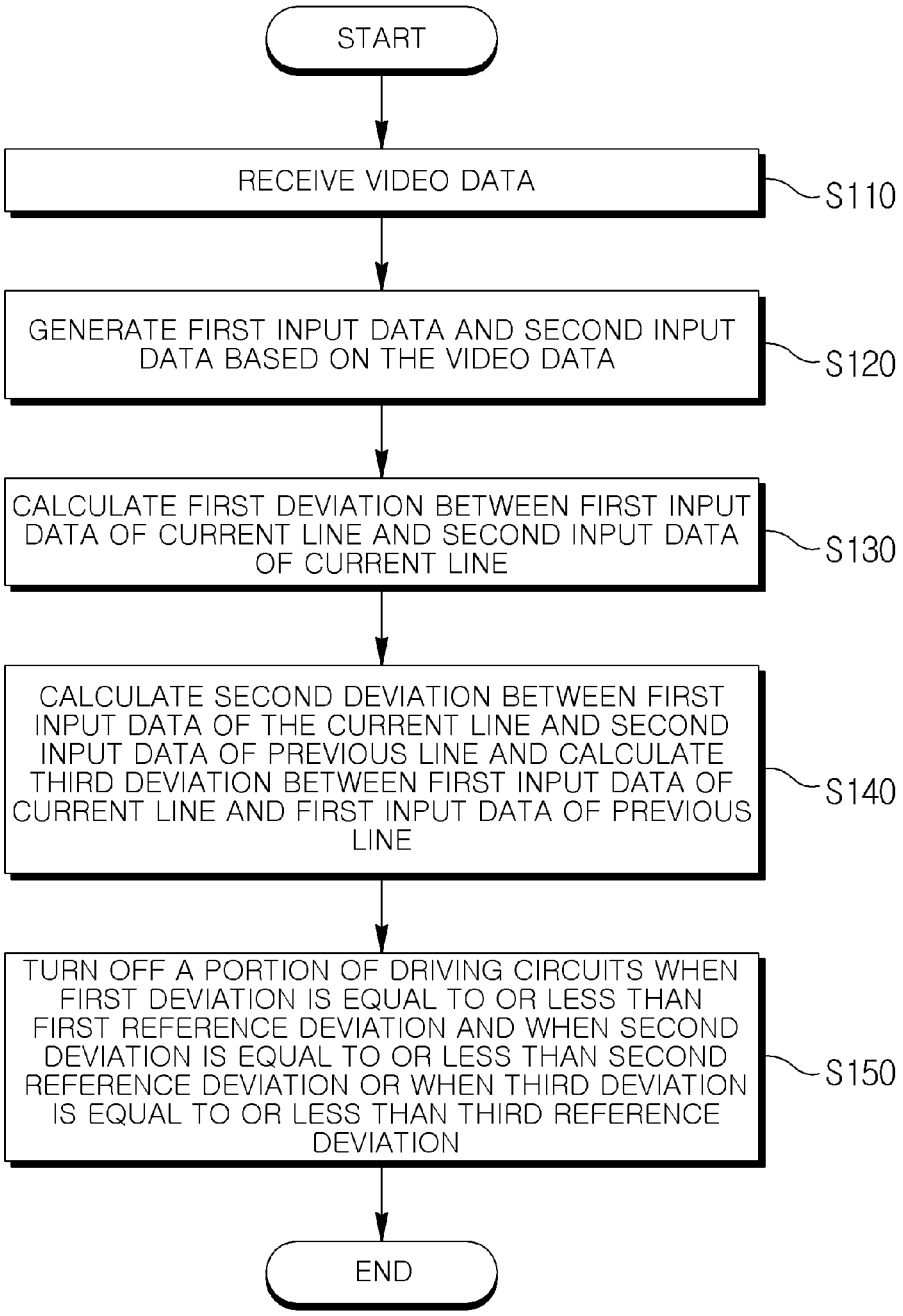
FIG. 8 is a flowchart showing the operation of the panel control circuit, according to one or more embodiments.

FIG. 8 is a flowchart showing the operation of the panel control circuit, according to one or more embodiments. Referring to FIGS. 1 to 8, the panel control circuit may receive the video data RGB from an external device in operation S110. According to embodiments, the video data RGB may be in a digital format. However, embodiments are not limited thereto.

The panel control circuit may generate the first input data IN1 and the second input data IN2 on the basis of the video data RGB in operation S120. For example, the first input data IN1 may be transmitted into the first driving circuit 310-1, and the second input data IN2 may be transmitted into the second driving circuit 310-2. According to the one or more embodiments, the timing controller 200 may generate the input data IN1 to INm by processing the video data RGB, and may transmit the input data IN1 to INm into the driving circuits 310-1 to **310-*m***.

The panel control circuit may calculate the first deviation DV1 between the first input data $IN1_{CUR}$ of the current line and the second input data $IN2_{CUR}$ of the current line in operation S130. According to the one or more embodiments, the timing controller 200 may include at least one logic circuit and may calculate the first deviation DV1 between the first input data $IN1_{CUR}$ of the current line and the second input data $IN2_{CUR}$ of the current line by using the at least one logic circuit.

The panel control circuit may calculate the second deviation DV2 between the first input data $IN1_{CUR}$ of the current line and the second input data $IN2_{PRV}$ of the previous line and may calculate the third deviation DV3 between the first input data $IN1_{CUR}$ of the current line and the first input data $IN1_{PRV}$ of the previous line in operation S140. According to the one or more embodiments, the timing controller 200 may include at least one logic circuit and may perform the above operations by using the included at least one logic circuit.

The panel control circuit may turn off a portion of the driving circuits 310-1 to **310-*m*, based on the first deviation DV1, the second deviation DV2, or the third deviation DV3 in operation S150. According to embodiments, the timing controller 200 may generate the control data CDATA when the first deviation DV1 is equal to or less than the first reference deviation and when the second deviation DV2 is equal to or less than the second reference deviation or when the third deviation DV3 is equal to or less than the third reference deviation. The timing controller 200 may transmit the control data CDATA to the second driving circuit 310-2. Then, the second driving circuit 310-2 may be turned-off in response to receiving the control data CDATA. When the second driving circuit 310-2 is turned-off, the switch SW connecting first driving circuit 310-1 and the second driving circuit 310-2** may be turned-on in response to the control signal CS generated by the control data CDATA, accordingly.

Figure 9:
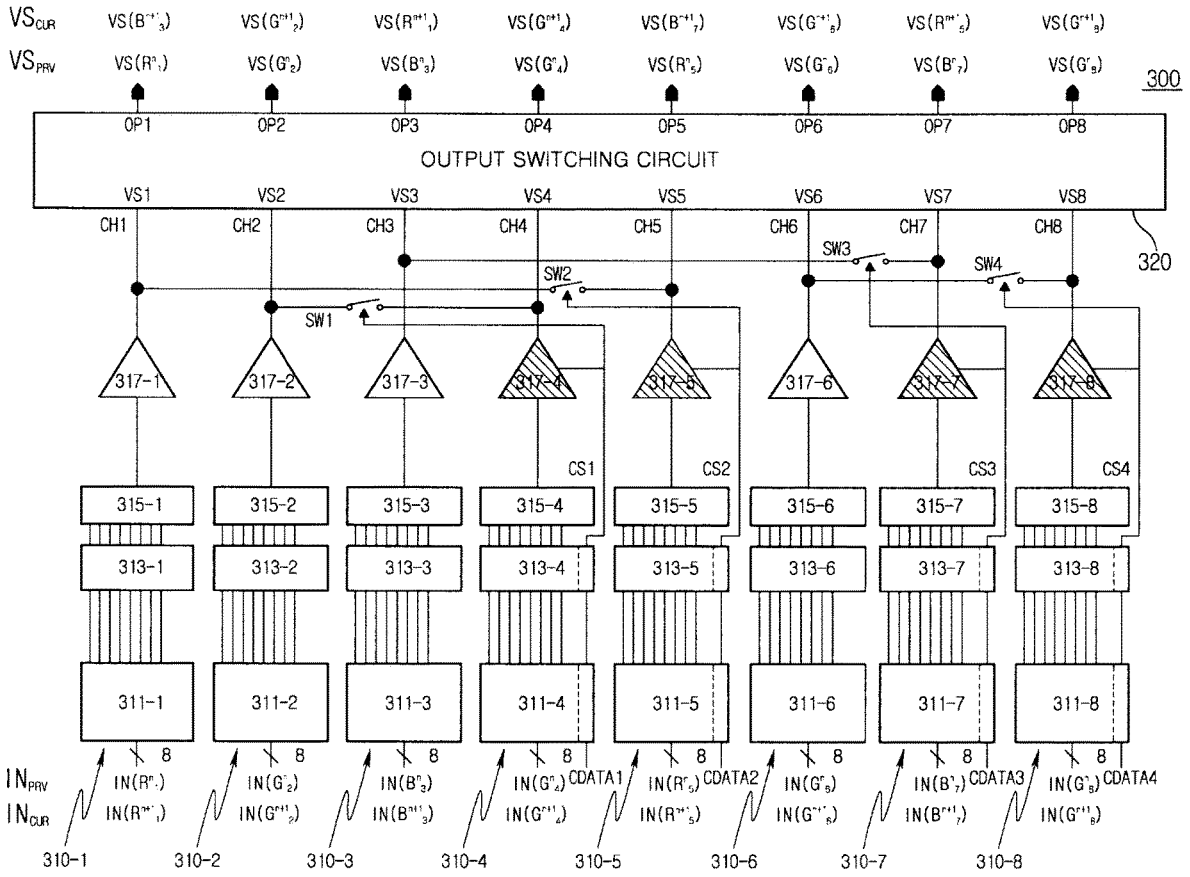
FIG. 9 shows a source driving circuit, according to one or more embodiments.

FIG. 9 shows a source driving circuit, according to one or more embodiments.

Referring to FIGS. 1 to 9, the source driving circuit 300 may receive the input data $IN_{CUR}$ and $IN_{PRV}$, and may generate and output video signals $VS_{CUR}$ and $VS_{PRV}$ based on the input data $IN_{CUR}$ and $IN_{PRV}$.

For convenience of description, the input data $IN_{CUR}$ and $IN_{PRV}$ of FIG. 9 may include input data for R pixels (red pixels), B pixels (blue pixels), and G pixels (green pixels), according to a non-limiting example. The superscript of the input data shown in FIG. 9 represents whether input data is that the current line, with a superscript of n+1, or that of the previous line, with a superscript n. The subscript of the input data shown in FIG. 9 identifies the input driving circuit. For example, the input data $IN(R^{n}_{1})$ may represent that it is an input data for the R pixel that is input to the first driving circuit 310-1 in the previous line n.

Similarly, the video signals $VS_{CUR}$ and $VS_{PRV}$ of FIG. 9 may include video signals for R pixels, B pixels, and G pixels, as non-limiting examples. The superscript of the video signal shown in FIG. 9 may represent whether the video signal is a current line with a superscript of n+1 or previous line with a superscript of n of the video signal. The subscript of the video signal shown in FIG. 9 identifies the input driving circuit. For example, the video signal $VS(B^{n+1}_{3})$ may represent that it is a video signal for the B pixel that is output through a first output pad OP1 after the data input through a third driving circuit 310-3 is switched in the current line n+1 by an output switching circuit 320.

As described above, in further detail with reference to FIG. 3, the plurality of driving circuits 310-1 to 310-8 may output the video signals VS based on the input data IN.

The output switching circuit 320 may receive the video signals VS1 to VS8 from the plurality of driving circuits 310-1 to 310-8, and may output the video signals VS1 to VS8 into the display panel 100. According to embodiments, the output switching circuit 320 may be connected to the plurality of driving circuits 310-1 to 310-8 and to the output pads OP1 to OP8, corresponding respectively to the plurality of driving circuits 310-1 to 310-8.

According to embodiments, the output switching circuit 320 may selectively output the first video signal VS1 output from the first driving circuit 310-1 from among the plurality of driving circuits 310-1 to 310-8, through the first output pad OP1 or the third output pad OP3. The output switching circuit 320 may selectively output the third video signal VS3 output from the third driving circuit 310-3, through the third output pad OP3 or the first output pad OP1.

As described above, the output switching circuit 320 may selectively output the fifth video signal VS5 output from the fifth driving circuit 310-5 from among the plurality of driving circuits 310-1 to 310-8, through the fifth output pad OP5 or the seventh output pad OP7. The output switching circuit 320 may selectively output the seventh video signal VS7 output from the seventh driving circuit 310-7, through the seventh output pad OP7 or the fifth output pad OP5.

According to embodiments, the output switching circuit 320 may include a plurality of switches or multiplexers that may selectively connect the driving circuits 310-1 to 310-8 and the output pads OP respectively, as a non-limiting example. However, the output switching circuit 320 may not be limited to such a particular example.

Each of the plurality of driving circuits 310-1 to 310-8 may receive the input data $IN_{PRV}$ and $IN_{CUR}$ transmitted from the timing controller 200, and may output the video signals $VS_{PRV}$ and $VS_{CUR}$ corresponding to the input data $IN_{PRV}$ and $IN_{CUR}$ into the display panel 100.

According to the one or more embodiments, the driving circuits 310-1 to 310-8 may include a set of driving circuits including driving circuits connected to each other. A portion of the driving circuits connected to each other included in one set of driving circuits may be turned-off, depending on a relationship between units of input data input to the one set of driving circuits. For example, a video signal to be output from the portion of the driving circuit that is turned-off may be replaced with a video signal output from the other driving circuits, included in the one set of driving circuits. Accordingly, the power consumption for driving the one set of driving circuits may be reduced.

In the example of the source driving circuit of FIG. 9, the first driving circuit 310-1 and the fifth driving circuit 310-5 may be connected to each other as the first set. The second driving circuit 310-2 and the fourth driving circuit 310-4 may be connected to each other as the second set. The third driving circuit 310-3 and the seventh driving circuit 310-7 may be connected to each other as the third set. The sixth driving circuit 310-6 and the eighth driving circuit 310-8 may be connected to each other as the fourth set. According to embodiments, the driving circuits within each set may be connected to each other through the switches SW1 to SW4.

According to embodiments, the driving circuits included in each set of driving circuits may process either of R pixels and B pixels, or may alternatively process G pixels.

The fifth driving circuit 310-5 of the first set (310-1 and 310-5) of driving circuits may be turned-off depending on a relationship between the input data $IN(R^{n+1}_1)$ and $IN(R^{n+1}_5)$ of the current line, which is input to the first set (310-1 and 310-5) of driving circuits, and the input data $IN(B^n_7)$ and $IN(B^n_3)$ of the previous line, which is input to the third set (310-3 and 310-7). When the fifth driving circuit 310-5 is turned-off, the second switch SW2 connecting the fifth driving circuit 310-5 and the first driving circuit 310-1 may be turned-on, so that the video signal VS1 output from the first driving circuit 310-1 may thus be output through the fifth channel CH5 connected to the fifth driving circuit 310-5.

According to embodiments, the timing controller 200 may generate the second control data CDATA2 on the basis of a relationship between the input data $IN(R^{n+1}_1)$ and $IN(R^{n+1}_5)$ of the current line, which is input to the first set (310-1 and 310-5) of driving circuits, and the input data $IN(B^n_7)$ and $IN(B^n_3)$ of the previous line, which is input to the third set (310-3 and 310-7). For example, the second control data CDATA2 may be or include 1-bit data. The generated second control data CDATA2 may be transmitted to the fifth driving circuit 310-5. The second control data CDATA2 may be input to the fifth latch 311-5 and may be transmitted to the fifth level shifter 313-5. The fifth level shifter 313-5 may output a second control signal CS2 by using the second control data CDATA2. The fifth output buffer 317-5 may be turned-off in response to the second control signal CS2, and accordingly, the fifth video signal VS5 may not be output. Also, the second switch SW2 may be turned-on in response to the second control signal CS2 and then may connect the first driving circuit 310-1 and the fifth driving circuit 310-5 to each other. Accordingly, the first video signal VS1 generated by the first driving circuit 310-1 may be output as the fifth video signal VS5, instead.

Similarly, the fourth driving circuit 310-4 of the second set (310-2 and 310-4) of driving circuits may be turned-off, depending on a relationship between the input data $IN(G^{n+1}_2)$, $IN(G^{n+1}_4)$, $IN(G^n_2)$, and $IN(G^n_4)$, which are input to the second set (310-2 and 310-4) of driving circuits. When the fourth driving circuit 310-4 is turned-off, the first switch SW1 connecting the fourth driving circuit 310-4 and the second driving circuit 310-2 may be turned-on, so that the video signal VS2 output from the second driving circuit 310-2 may be output through the fourth channel CH4 connected to the fourth driving circuit 310-4.

According to embodiments, the timing controller 200 may generate the first control data CDATA1 based on a relationship between the input data $IN(G^{n+1}_2)$, $IN(G^{n+1}_4)$, $IN(G^n_2)$, and $IN(G^n_4)$, which are input to the second set (310-2 and 310-4) of driving circuits. The fourth driving circuit 310-4 may be turned-off, depending on the first control data CDATA1.

Similarly, the seventh driving circuit 310-7 of the third set (310-3 and 310-7) of driving circuits may be turned-off depending on a relationship between the input data $IN(B^{n+1}_3)$ and $IN(B^{n+1}_7)$ of the current line, which is input to the third set (310-3 and 310-7) of driving circuits, and the input data $IN(R^n_1)$ and $IN(R^n_5)$ of the previous line, which is input to the first set (310-1 and 310-5). When the seventh driving circuit 310-7 is turned-off, the third switch SW3 connecting the seventh driving circuit 310-7 and the third driving circuit 310-3 may be turned-on, so that the video signal VS3 output from the third driving circuit 310-3 may be output through the seventh channel CH7, connected to the seventh driving circuit 310-7.

According to embodiments, the timing controller 200 may generate the third control data CDATA3 based on a relationship between the input data $IN(B^{n+1}_3)$ and $IN(B^{n+1}_7)$ of the current line, which is input into the third set (310-3 and 310-7) of driving circuits, and the input data $IN(R^n_1)$ and $IN(R^n_5)$ of the previous line, which is input to the first set (310-1 and 310-5) of driving circuits. The seventh driving circuit 310-7 may be turned-off, depending on the third control data CDATA3.

Similarly, the eighth driving circuit 310-8 of the fourth set (310-6 and 310-8) of driving circuits may be turned-off, depending on a relationship between the input data $IN(G^{n+1}_6)$, $IN(G^{n+1}_8)$, $IN(G^n_6)$, and $IN(G^n_8)$ that are input into the fourth set (310-6 and 310-8) of driving circuits. When the eighth driving circuit 310-8 is turned-off, the fourth switch SW4 connecting the eighth driving circuit 310-8 and the sixth driving circuit 310-6 may be turned-on, so that the video signal VS6 output from the sixth driving circuit 310-6 may be output through the eighth channel CH8 connected to the eighth driving circuit 310-8.

According to embodiments, the timing controller 200 may generate the fourth control data CDATA4 on the basis of a relationship between the input data $IN(G^{n+1}_6)$, $IN(G^{n+1}_8)$, $IN(G^n_6)$, and $IN(G^n_8)$ that are input to the fourth set (310-6 and 310-8) of driving circuits. The eighth driving circuit 310-8 may be turned-off, depending on the fourth control data CDATA4.

Accordingly, a portion of the driving circuits connected to each other included in one set of driving circuits may be turned-off, depending on a relationship between the input data input into the one set of driving circuits. Here, a video signal to be output from the portion of the driving circuit that is turned-off may be replaced with a video signal output from the other driving circuits included in the one set of driving circuits. Accordingly, the power consumption for driving the one set of driving circuits may be reduced.

Figure 10:
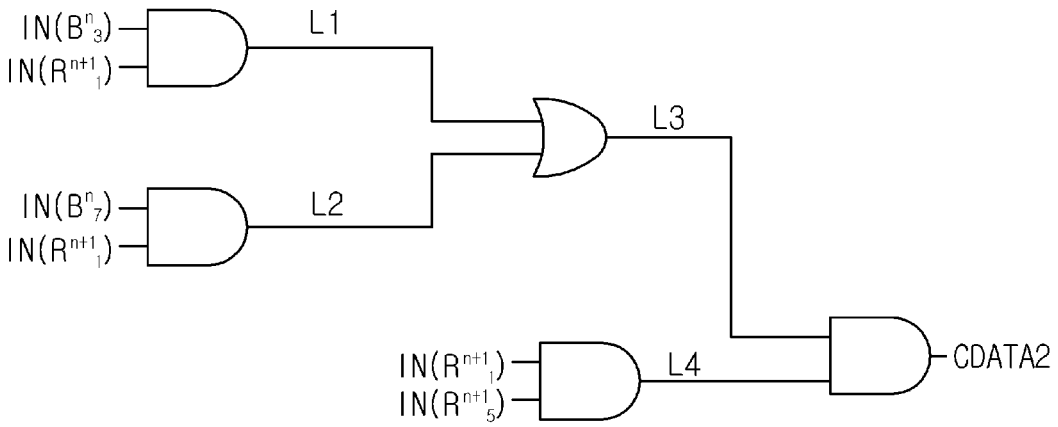
FIGS. 10 to 12 are views for describing the operation of the control data generation circuit shown in FIG. 9.
Figure 11:
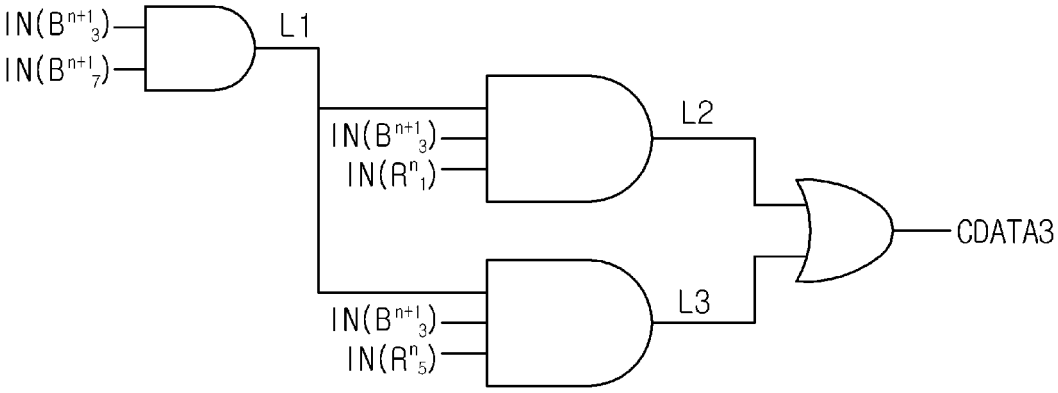
Figure 12:
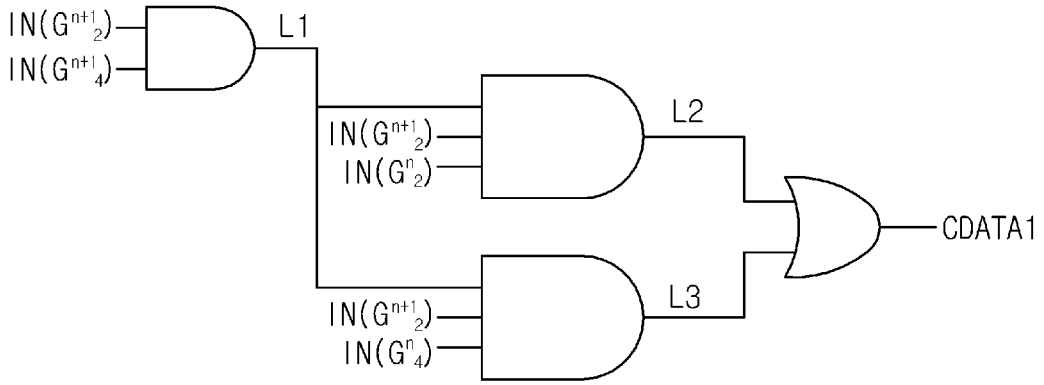

FIGS. 10 to 12 are views for illustrating the operation of the control data generation circuit shown in FIG. 9. As described with reference to FIG. 4, the control data generation circuit 230 may generate the control data CDATA based on the input data $IN_{PRV}$ of the previous line and the input data $IN_{CUR}$ of the current line.

FIGS. 10 to 12 illustrate comparison logic between the input data $IN_{PRV}$ of the previous line and input data $IN_{CUR}$ of the current line in the control data generation circuit 230.

Subsequently, the logical operations described in FIGS. 10 to 12 may be bitwise logical operations. According to one or more embodiments, the number of bits of the bitwise logical operation may be equal to or less than the number of bits of the input data. For example, while the input data is 8-bit data, the number of bits of the bit logical product may be 8-bit data. In this example, even though the bit logical product has a three-bit difference from the 8-bit input data, it may be determined that the above two input data are the same.

Referring to FIG. 10, the control data generation circuit 230 may calculate a result value L1 of the logical product (an AND operation) of the input data $IN(B^n_3)$ and the input data $IN(R^{n+1}_1)$. According to embodiments, the control data generation circuit 230 may calculate the result value L1 of bit 1 when the input data $IN(B^n_3)$ and the input data $IN(R^{n+1}_1)$ are identical in terms of their bits.

The control data generation circuit 230 may calculate a result value L2 of the logical product of the input data $IN(B^n_7)$ and the input data $IN(R^{n+1}_1)$.

The control data generation circuit 230 may calculate a result value L3 of a logical sum of the result value L1 and the result value L2.

The control data generation circuit 230 may calculate a result value L4 of the logical product of the input data $IN(R^{n+1}_1)$ and the input data $IN(R^{n+1}_5)$.

The control data generation circuit 230 may generate a result value of the logical product of the result value L3 and the result value L4 as the control data CDATA. According to embodiments, the control data generation circuit 230 may generate the result value of the logical product of the result value L3 and the result value L4 as the second control data CDATA2.

Referring to FIG. 11, the control data generation circuit 230 may calculate a result value L1 of the logical product (an AND operation) of the input data $IN(B^{n+1}_3)$ and the input data $IN(B^{n+1}_7)$.

The control data generation circuit 230 may calculate a result value L2 of the logical product of the result value L1, the input data $IN(B^{n+1}_3)$ and the input data $IN(R^n_1)$.

The control data generation circuit 230 may calculate a result value L3 of the logical product of the result value L1, the input data $IN(B^{n+1}_3)$ and the input data $IN(R^n_5)$.

The control data generation circuit 230 may calculate a logical sum (an OR operation) of the result value L2 and the result value L3 as the control data CDATA. According to the embodiments, the control data generation circuit 230 may generate the logical sum of the result value L2 and the result value L3 as the third control data CDATA3.

Referring to FIG. 12, the control data generation circuit 230 may calculate a result value L1 of the logical product of the input data $IN(G^{n+1}_2)$ and the input data $IN(G^{n+1}_4)$.

The control data generation circuit 230 may calculate a result value L2 of the logical product of the result value L1, the input data $IN(G^{n+1}_2)$ and the input data $IN(G^n_2)$.

The control data generation circuit 230 may calculate a result value L3 of the logical product of the result value L1, the input data $IN(G^{n+1}_2)$, and the input data $IN(G^n_4)$.

The control data generation circuit 230 may calculate a logical sum of the result value L2 and the result value L3 as the control data CDATA. According to embodiments, the control data generation circuit 230 may generate the logical sum of the result value L2 and the result value L3 as the first control data CDATA1.

The method of generating the fourth control data CDATA4 may be largely the same as the method of generating the first control data CDATA1, with the exception of the fact that data to be input are different. Therefore, a description of a method of generating the fourth control data CDATA4 is omitted, for brevity.

While this disclosure comprises specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A panel control circuit for controlling a display panel comprising a first data line and a second data line, the panel control circuit comprising:

a timing controller configured to generate input data comprising a first input data and a second input data;

a first driving circuit configured to output a first video signal corresponding to the first input data into the first data line; and a second driving circuit configured to output a second video signal corresponding to the second input data into the second data line, wherein the timing controller is configured to turn off the second driving circuit based on:

a first deviation between the second input data of a current line input to the second driving circuit and the first input data of the current line input to the first driving circuit, and a second deviation between the first input data of the current line transmitted from an input data generation circuit and input to the first driving circuit, and the second input data of a previous line read from an input data buffer of the timing controller and input to the second driving circuit.

2. The panel control circuit of claim 1, wherein the timing controller is configured to generate a control data used for turning off the second driving circuit, based on the first deviation and the second deviation.

3. The panel control circuit of claim 2, wherein the timing controller comprises:

the input data generation circuit configured to generate the first and second input data;

the input data buffer configured to store the second input data of the previous line generated by the input data generation circuit; and a control data generation circuit configured to generate the control data by using the first input data of the current line transmitted from the input data generation circuit and the second input data of the previous line read from the input data buffer.

4. The panel control circuit of claim 3, wherein the control data generation circuit comprises at least one logic circuit configured to calculate the first deviation, and the second deviation.

5. The panel control circuit of claim 2, wherein the timing controller is configured to generate the control data used for turning off the second driving circuit , in response to the first deviation being equal to or less than a first reference deviation and in response to the second deviation being equal to or less than a second reference deviation.

6. The panel control circuit of claim 5, wherein the first reference deviation is less than the second reference deviation.

7. The panel control circuit of claim 2, wherein the timing controller is configured to generate the control data as 1-bit data.

8. The panel control circuit of claim 7, wherein the timing controller is configured to pad the control data onto the second input data, and configured to output the second input data onto which the control data has been padded into the second driving circuit.

9. The panel control circuit of claim 2, wherein the first driving circuit comprises:

a first latch configured to store the first input data, a first conversion circuit configured to convert the first input data output from the first latch into a first analog value, and a first output buffer configured to output the first video signal using the first analog value output by the first conversion circuit.

10. The panel control circuit of claim 9, wherein the second driving circuit comprises:

a second latch configured to store the second input data;

a second conversion circuit configured to convert the second input data output from the second latch into a second analog value; and a second output buffer configured to output the second video signal using the second analog value output by the second conversion circuit, wherein the second latch is configured to receive the control data and output the control data into the second conversion circuit, and wherein the second conversion circuit is configured to generate a control signal for turning off the second output buffer, based on the control data.

11. The panel control circuit of claim 9, further comprising a switch configured to transfer the first video signal of the first output buffer into an output terminal of the second output buffer, wherein the switch is turned on in response to the control signal.

12. The panel control circuit of claim 1, further comprising a switch that electrically connects the first driving circuit and the second driving circuit when the second driving circuit is turned off.

13. A panel control circuit for controlling a display panel comprising data lines, the panel control circuit comprising:

driving circuits comprising a first driving circuit and a second driving circuit, and configured to output a plurality of input data comprising a first input data and a second input data into the data lines;

a timing controller configured to output the plurality of input data; and an output switching circuit configured to switch a portion of the plurality of input data and configured to output into the data lines, wherein the timing controller is configured to turn off the second driving circuit based on:

a first deviation between the second input data of a current line input to the second driving circuit and the first input data of the current line input to the first driving circuit, and a second deviation between the first input data of the current line transmitted from an input data generation circuit and input to the first driving circuit, and the second input data of a previous line read from an input data buffer of the timing controller and input to the second driving circuit.

14. The panel control circuit of claim 13, wherein the timing controller is configured to generate a control data used for turning off the second driving circuit that outputs the second input data, based on the first deviation and the second deviation.

15. The panel control circuit of claim 14, wherein the timing controller is configured to generate the control data used for turning off the second driving circuit that outputs the second input data, in response to the first deviation being equal to or less than a first reference deviation and in response to the second deviation being equal to or less than a second reference deviation.

16. The panel control circuit of claim 14, wherein the timing controller is configured to pad the control data onto the second input data, and configured to output the padded data through the driving circuit that outputs the second input data.

17. A panel control circuit for controlling a display panel comprising data lines, the panel control circuit comprising:

driving circuits configured to output a plurality of input data into the data lines;

a timing controller configured to output the plurality of input data comprising a first input data and a second input data; and an output switching circuit configured to switch a portion of the plurality of input data and configured to output into the data lines, wherein the timing controller is configured to turn off a second driving circuit of the driving circuits based on:

a first deviation between the second input data of a current line input to the second driving circuit and the first input data of the current line input to a first driving circuit, and a second deviation between the first input data of the current line transmitted from an input data generation circuit and input to the first driving circuit, and the second input data of a previous line read from an input data buffer of the timing controller and input to the second driving circuit.

18. The panel control circuit of claim 17, wherein the timing controller is configured to generate a control data for turning off the second driving circuit that outputs the second input data, based on the first deviation and the second deviation.

19. The panel control circuit of claim 18, wherein the timing controller is configured to generate the control data for turning off the second driving circuit that outputs the second input data, in response to the first deviation being equal to or less than a first reference deviation and in response to the second deviation being equal to or less than a second reference deviation.

20. The panel control circuit of claim 18, wherein the timing controller is configured to pad the control data onto the second input data, and configured to output the padded data through the second driving circuit that outputs the second input data.

21. A panel control circuit for controlling a display panel comprising a first data line and a second data line, the panel control circuit comprising:

a timing controller configured to generate input data comprising a first input data and a second input data;

a first driving circuit configured to output a first video signal corresponding to the first input data into the first data line;

a second driving circuit configured to output a second video signal corresponding to the second input data into the second data line; and a switch configured to electrically connect the first driving circuit and the second driving circuit in response to the second driving circuit being turned off, wherein the timing controller is configured to turn off the second driving circuit based on:

a first deviation between the first input data of a current line and the second input data of the current line, and a second deviation between the first input data of the current line transmitted from an input data generation circuit and input to the first driving circuit, and the second input data of a previous line read from an input data buffer of the timing controller and input to the second driving circuit.

22. The panel control circuit of claim 21, wherein the timing controller is configured to generate a control data used for turning off the second driving circuit, based on the first deviation and the second deviation.

* * * * *